US010750783B2

(12) United States Patent
Zayach

(10) Patent No.: US 10,750,783 B2
(45) Date of Patent: Aug. 25, 2020

(54) UNIVERSAL ADJUSTABLE NAIL ASSEMBLY FOR CONCENTRATE VOLATILIZATION AND DELIVERY

(71) Applicant: Andrew Zayach, Cottonwood Heights, UT (US)

(72) Inventor: Andrew Zayach, Cottonwood Heights, UT (US)

( * ) Notice: Subject to any disclaimer, the term of this patent is extended or adjusted under 35 U.S.C. 154(b) by 10 days.

(21) Appl. No.: 15/378,274

(22) Filed: Dec. 14, 2016

(65) Prior Publication Data

US 2018/0160731 A1 Jun. 14, 2018

(51) Int. Cl.
*A24F 47/00* (2020.01)

(52) U.S. Cl.
CPC ..... *A24F 47/008* (2013.01); *A24F 47/004* (2013.01)

(58) Field of Classification Search
CPC .... A24F 47/002; A24F 47/004; A24F 47/006; A24F 47/008; A24F 1/30; A61M 15/06
USPC ..... 131/193, 194, 196, 226, 328, 329; 392/376
See application file for complete search history.

(56) References Cited

U.S. PATENT DOCUMENTS

| | | | | |
|---|---|---|---|---|
| 8,851,082 | B2 * | 10/2014 | Carney | A61L 9/03 131/226 |
| 9,930,911 | B1 * | 4/2018 | Wright | A24F 5/00 |
| 10,051,886 | B2 * | 8/2018 | De Gaglia | A24F 1/30 |
| 2014/0251355 | A1 * | 9/2014 | Tracey | A24F 1/30 131/328 |
| 2015/0013699 | A1 * | 1/2015 | Ellis | A24F 47/008 131/329 |
| 2015/0209530 | A1 * | 7/2015 | White | A61M 11/042 424/729 |
| 2016/0015083 | A1 * | 1/2016 | Castillo | A24F 47/008 131/329 |
| 2017/0079324 | A1 * | 3/2017 | Eksouzian | A24F 47/008 |
| 2018/0125115 | A1 * | 5/2018 | Mueller | A24F 5/04 |

* cited by examiner

*Primary Examiner* — William V Gilbert
(74) *Attorney, Agent, or Firm* — Steven Rinchart

(57) ABSTRACT

A titanium alloy nail for use in connection with the volatilization of concentrate, including *cannabis* extract. The nail interchanges with various standardized male and female grounded joints. The components of the nail may are detachably threadable to one another and configurable to adapt to fit any number of a multitude of configurations, including ten standardized joints.

7 Claims, 7 Drawing Sheets

UNIVERSAL ADJUSTABLE NAIL ASSEMBLY FOR CONCENTRATE VOLATILIZATION AND DELIVERY

BACKGROUND OF THE INVENTION

Field of the Invention

This invention relates to an apparatus for volatilization of organic and synthetic concentrates, and more particularly relates to implements adapted to facilitate the volatilization of concentrate before downstream transfer to a water vessel.

Description of the Related Art

Nails and adapters for the volatilization and inhalation of organic and synthetic substances are well known for aromatherapy, respiratory therapy, recreation, and medicinal purposes. Typically a concentrate of an organic or synthetic extract is heated to the point at which it undergoes phase change into a gas before being inhaled through an apparatus known as a water vessel.

In various embodiments, an interchangeable implement detachable to a stem (or grounded joint) of the water vessel known as a "nail" is used in connection with the water vessel as a delivery vehicle to transfer atomized or volatilized concentrate downstream, as well as to manage the heat needed to vaporize, or volatilize, the concentrate. The nail is often preheated beyond a predetermined temperature threshold before introduction and application (or "dabbing") of the concentrate to avoid combustion and loss of the concentrate using a torch or other heating means. A glass or ceramic enclosure known as a "globe" or "dome" may be fitted around the nail in some embodiments to preserve atomized gases before inhalation. These domes are typically cumbersome and are becoming obsolete.

Current technology in the art is inefficient. Water vessels come in wide variety of sizes and shapes, some with female grounded joints and others with mail grounded joints. Typical joint sizes vary from less than 10 millimeters to more than 30 millimeters. Some stems, fittings, or joint sizes, have become standardized or quasi-standardized, including 14 millimeter male or female joints, 14.5 millimeter, 18 millimeter male and female joints, 18.8 millimeter, 24 millimeter male and female joints, 29.2 millimeter male and female joints, and others. Previous to the present invention, there were no nails or adapters in the art which are universal, or which fit all standardized stem sizes.

Typical nails comprise a flat or concave receptacle into which the concentrate essential oils are placed, or dabbed, and volatilized. The vapors are usually directed by negative pressure using inhalation around the outside of the titanium nail and funneled down into the water vessel.

Many types of concentrate and essential oils may be volatized using nails. *Cannabis* plants are among the most popular for medicinal and recreational purposes. *Cannabis* plants include an annual, dioecious, flowering herb that includes three species, *sativa, indica*, and *ruderalis*. Generally, *cannabis* plants produce oil containing packets called trichromes. The cannabinoids and oils produced by the plant are contained within those trichromes. Trichromes are present in larger quantities on the buds and flowers of the female *cannabis* plant, but are also known to be present on other parts such as leaves and the associated trimmings that result from manicuring the dried buds.

Chemicals of tetrahydrocannabinol (THC) and cannabidiol (CBD) are a substantial and desirable product derived from the *cannabis* plant. Methods of extraction of THC and CBD which have been used to separate constituents of *cannabis* plants into plant medicines and to produce enriched extracts include maceration, decoction, and extraction with aqueous and non-aqueous solvents, distillation, and sublimation.

The present invention allows user to enjoy the benefits of volatized oils and concentrates, including *cannabis* oil, using a single adapter or nail universally interchangeable and configurable to be used in connection with any stem or grounded joint.

Current methods and apparati do not provide universal adaption means. It is therefore desirable that a universal adjustable nail assembly for concentrate volatilization detachable to the stem of a water vessel be provided.

SUMMARY OF THE INVENTION

From the foregoing discussion, it should be apparent that a need exists for a universal interchangeable nail assembly. Beneficially, such an apparatus would overcome many of the difficulties with the prior art by providing a plurality of multiconfigurable components adaptable for use with any sized grounded joint.

The present invention has been developed in response to the problems and needs in the art that have not yet been fully solved by currently available apparati and methods. Accordingly, the present invention has been developed to provide a universal adjustable nail assembly for vaporization and delivery or an extract, the nail assembly comprising: a metal base cap comprising a cylindrical body having two open ends, one of the open ends defining an aperture of sufficient diameter to receive the proximal end of the shaft; a male dish comprising a cylindrical enclosure with an open top end, the open top end having a circumscribing annular sidewall and interior planar floor defining a centric aperture for allow through passage of vapor, the open top end for receiving concentrate dabbed by a user, the open top end between 2 millimeters and 50 millimeters in diameter; a female base comprising an outer skirt of 2 millimeters to 50 millimeters in diameter, the outer skirt having an open bottom end for receiving a male grounded joint of a tool housing unit, the outer skirt affixed at a top end to a cylindrical mid skirt of smaller diameter than the diameter of the outer skirt for receiving a male grounded joint, the mid skirt affixed to a cylindrical top portion having exterior threads, the top portion defining an open top end; and a female base comprising a cylindrical body with a knurled exterior surface, the cylindrical body comprising a plurality of annular fins, the female base comprising a planar top surface defining an aperture threaded to mate with a male portion of an adjoining component, the female base comprising an open bottom end for receiving a male grounded joint.

The nail assembly may further comprise a stylus comprising an elongated shaft having a distal end and a proximal end, the distal end of the shaft comprising an applicator, the proximal end of the shaft threaded exteriorly.

The nail assembly further comprises, in some embodiments: a tool housing unit comprising a hollow cylindrical body for receiving the female base, the stylus, the metal base cap, the female base, and the male dish, the tool housing unit comprising two open ends, wherein the bottom open end is threaded interiorly; and a housing unit cap comprising a circular body having exterior threads for mating with interior threading on the open bottom end of the tool housing unit, the housing unit cap having a lower portion with exterior threads.

The top portion may comprise a notched outer rim.

Each of the female base, the stylus, the metal base cap, the female base, and the male dish may be formed as a single integrated piece.

The nail assembly in still further embodiments comprises an electrical heating coil for heating the nail assembly to a predetermined temperature sufficient to vaporize concentrate.

The nail assembly may further comprising a carb cap comprising an outer skirt of 2 millimeters to 50 millimeters in diameter, the outer skirt having an open bottom end for receiving a male grounded joint of a tool housing unit.

Each of the female base, the stylus, the metal base cap, the female base, and the male dish may be inverted and threadably interconnected in a configuration adapted to join with one of a plurality of grounded joints of a tool housing unit of standardized size.

The nail assembly may be adaptable to fit ten standard sized joints. The standardized sizes may comprise: a 10 millimeter male or female joint; a 12.5 millimeter male or female joints; a 14.5 millimeter male or female joint; an 18.8 millimeter male or female joint; an 18 millimeter female joint; an 18.8 millimeter female joint; and a 24 millimeter male or female joint.

A second universal adjustable nail assembly is provided, the nail assembly comprising: a metal base cap comprising a cylindrical body having two open ends, one of the open ends defining an aperture of sufficient diameter to receive the proximal end of the shaft; a male dish comprising a cylindrical enclosure with an open top end, the open top end having a circumscribing annular sidewall and interior planar floor defining a centric aperture for allow through passage of vapor, the open top end for receiving concentrate dabbed by a user, the open top end between 2 millimeters and 50 millimeters in diameter; a female base comprising an outer skirt of 2 millimeters to 50 millimeters in diameter, the outer skirt having an open bottom end for receiving a male grounded joint of a tool housing unit, the outer skirt affixed at a top end to a cylindrical mid skirt of smaller diameter than the diameter of the outer skirt for receiving a male grounded joint, the mid skirt affixed to a cylindrical top portion having exterior threads, the top portion defining an open top end; a female base comprising a cylindrical body with a knurled exterior surface, the cylindrical body comprising a plurality of annular fins, the female base comprising a planar top surface defining an aperture threaded to mate with a male portion of an adjoining component, the female base comprising an open bottom end for receiving a male grounded joint; a second male dish comprising a cylindrical enclosure with an open top end, the open top end having a circumscribing annular sidewall and interior planar floor; the second male dish comprising a rising threaded collar protruding upwardly from the planar floor, the threaded collar defining a hollow passageway with interior threading, the open top end for receiving concentrate dabbed by a user, the open top end between 2 millimeters and 50 millimeters in diameter; a tool housing unit comprising a hollow cylindrical body for receiving the female base, the stylus, the metal base cap, the female base, and the male dish, the tool housing unit comprising two open ends, wherein the bottom open end is threaded interiorly; and a housing unit cap comprising a circular body having exterior threads for mating with interior threading on the open bottom end of the tool housing unit, the housing unit cap having a lower portion with exterior threads.

The nail assembly may further comprise a stylus comprising an elongated shaft having a distal end and a proximal end, the distal end of the shaft comprising an applicator, the proximal end of the shaft threaded exteriorly.

Each of the female base, the stylus, the metal base cap, the female base, and the male dish may be inverted and threadably interconnected in a configuration adapted to joint with a plurality of grounded joint of a tool housing unit of standardized sizes.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It an object of the present invention to provide a ten-way adapter which is compatible with ten different sized grounded joints, both male and female, formed from a titanium alloy.

Figure 1:
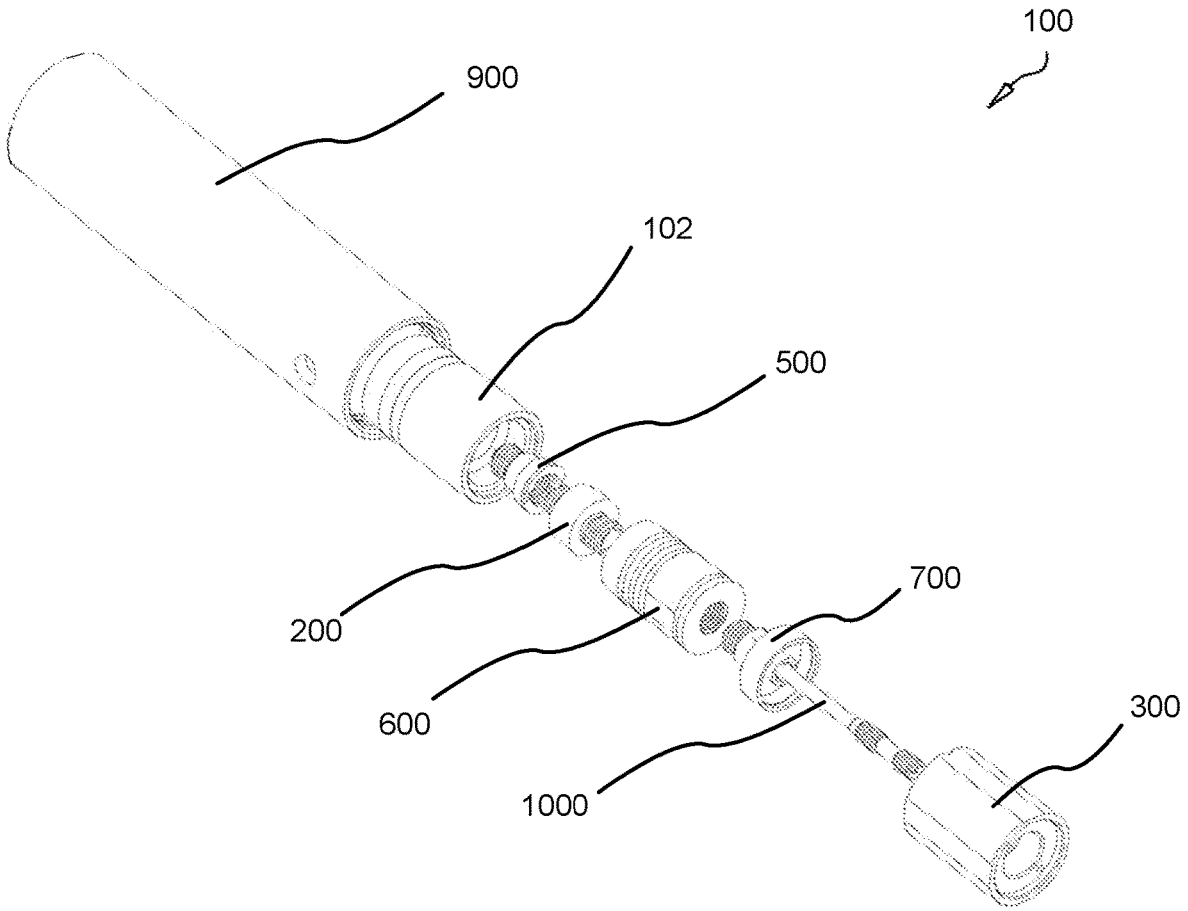
FIG. 1 is a lower side perspective view of a universal adjustable nail assembly for concentrate vaporization and delivery positioned for stock configuration in accordance with the present invention.

FIG. 1 illustrates a lower side perspective view of a universal adjustable nail assembly 100 for concentrate volatilization and delivery in stock configuration in accordance with the present invention. The assembly 100 comprises a tool housing unit 900, carb cap 102, a third female base 500, a first female base 200, a second female base 600, a dish 700, a stylus 1000, and a carb cap 300. Each the components, 102, 200, 500, 600, 700, 1000, and 300 are threaded together and joined within a tool housing unit.

Those of skill in the art may include or exclude any of the components and assemble the remaining components as necessary to meet the particularized needs of any user of the nail assembly 100. Each of these components are described further below.

Figure 2:
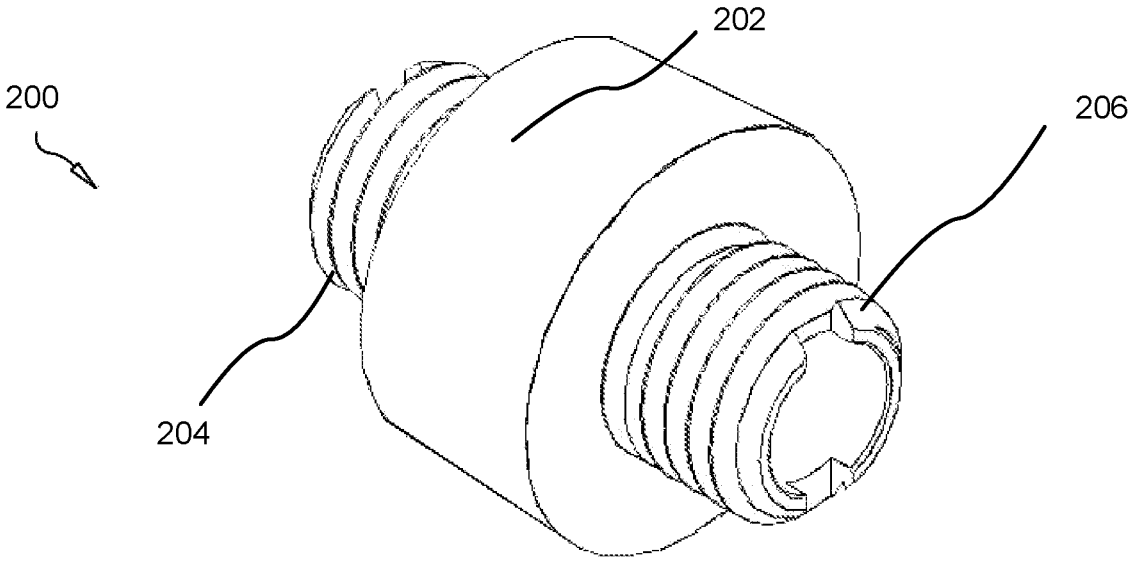
FIG. 2 is a lower side perspective view of a female base of an adjustable nail assembly for concentrate vaporization and delivery in its stock configuration in accordance with the present invention.

FIG. 2 is a lower side perspective view of a female base 200 of an adjustable nail assembly for concentrate volatilization and delivery in its stock configuration in accordance with the present invention.

The female base 200 optionally interconnects female ends of opposing components in the assembly 100. The female base 200 defines a hollow bore traversing the base 200 longitudinally from an open top end to an open bottom end. The base 200 comprises a cylindrical body 202, or enclosure 202, affixed to two protruding shortened shafts extending outwardly from the top end and the bottom end. Each shaft defines a hollow recess forming a path for vapor to the tool housing unit.

The shafts may comprise outer threads 204, which outer threads 204 may comprise acme threads. The shafts may comprise a notched rim 206 (or flange) for facilitating induction of vapor or air to the hollow bore. The notches or slits are defined by the outer rim.

The base 200 is adapted to mate which other components of the assembly 100 to form a nail for use in vapor inhalation. By including, excluding, inverting, and threadably affixing the various components of the assembly 100, those of skill in the art will recognize that the components of the nail assembly can be assembled by a user for any size stem on a tool housing unit, male or female.

Figure 3:
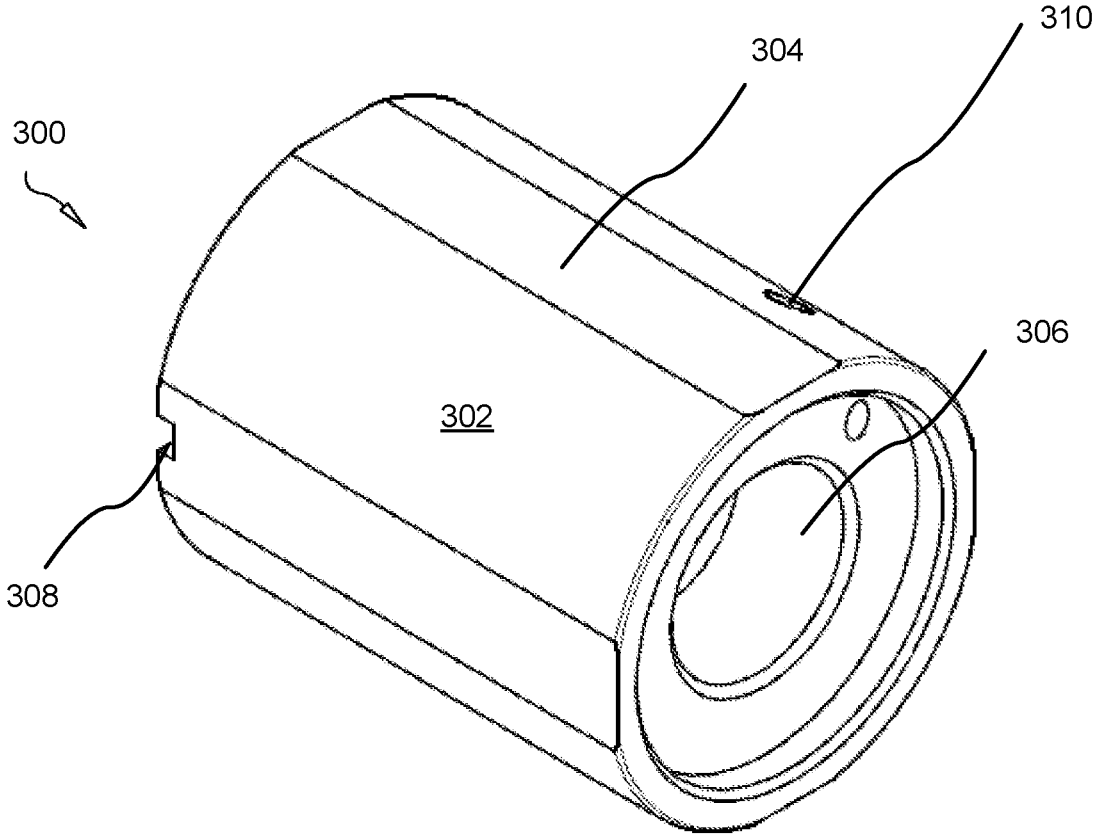
FIG. 3 is a lower side perspective view of a female base of an adjustable nail assembly for concentrate vaporization and delivery in its stock configuration in accordance with the present invention.

FIG. 3 is a lower side perspective view of a male base 300 of an adjustable nail assembly for concentrate volatilization and delivery in its stock configuration in accordance with the present invention.

The male base 300 comprises a cylindrical body 302 having knurled exterior surfacing 304 defining one or more planar facets for facilitating secure engagement and axial rotation of the metal base cap 300 by a user using a tool.

The cylindrical body 302 defines two open ends, one at the top and one at the bottom. The bottom open end comprising a planar interior floor defines a hollow circular aperture 306 interconnecting the open top end and the open bottom end.

The open top end comprises a rim which may define a notch or slit 308 for facilitating the free flow of air and vapor to the bore hole traversing each component of the assembly 100.

The cylindrical body 302 defines a side hole 310 interiorly-threaded to receive a stylus or dabber implement (or applicator) protruding horizontally from the cylindrical body 302.

Figure 4A:
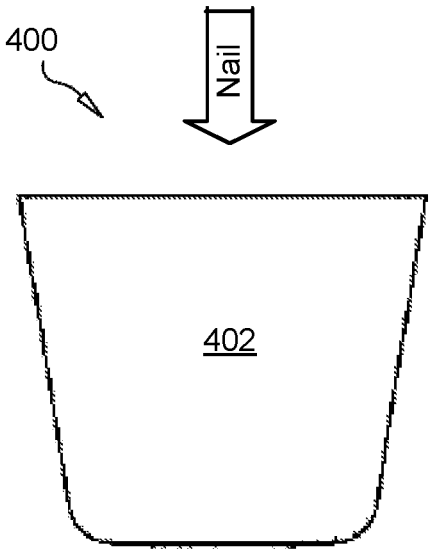
FIG. 4A is a side perspective view of a female water vessel stem in accordance with the present invention.

FIG. 4A illustrates a side perspective view of a female stem of a water vessel in accordance with the present invention. The nail assembly, including any configuration of nail assembly 100, inserts into the open top open end of the female stem 402.

The female stem 402 comprises an open top enclosure. Vapors flow downstream through a nail assembly 100 into a tool housing unit through the female stem 402 which mates with the carb caps of the nail assembly 100.

Figure 4B:
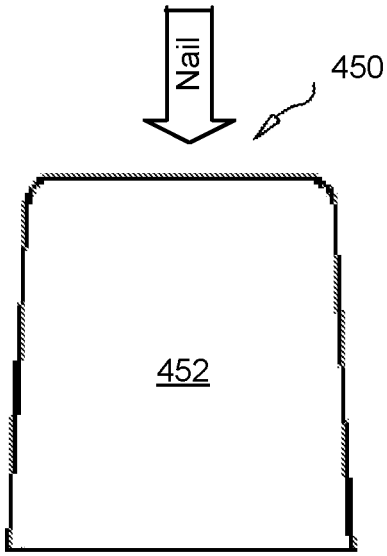
FIG. 4B is a side perspective view of a male water vessel stem in accordance with the present invention.

FIG. 4B illustrates a side perspective view of a male stem of a water vessel in accordance with the present invention.

The male stem 452 comprises an open top enclosure. Vapors flow downstream through a nail assembly 100 through the female stem 402 which mates with the female bases of the nail assembly 100.

Figure 5:
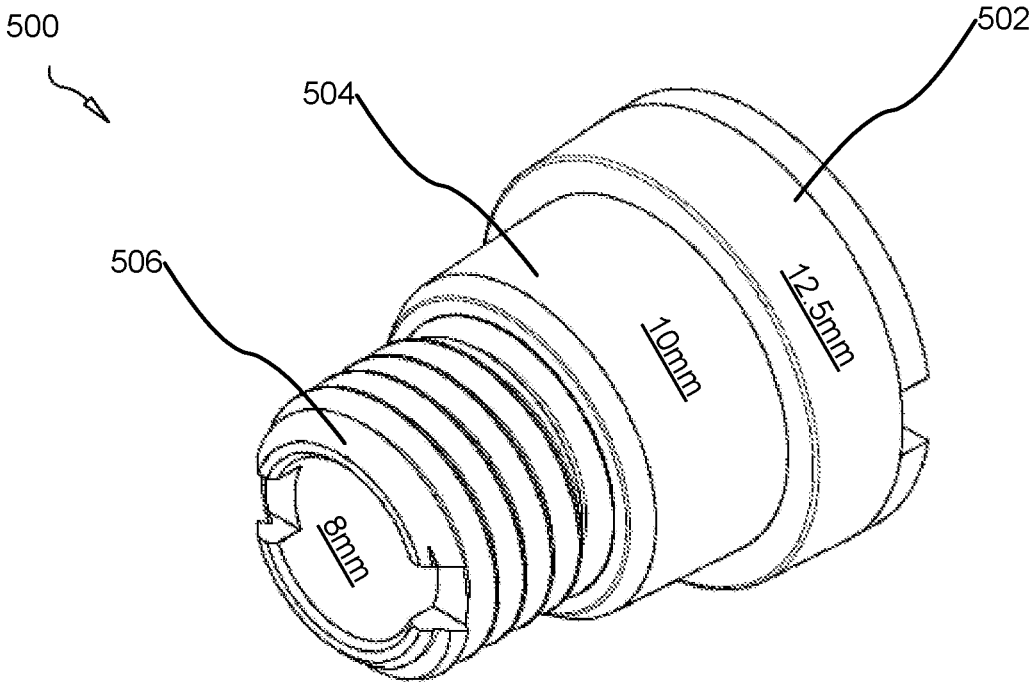
FIG. 5 is a lower side perspective view of a female base of an adjustable nail assembly for concentrate vaporization and delivery in its stock configuration in accordance with the present invention.

FIG. 5 is a lower side perspective view of a third female base 500 of an adjustable nail assembly for concentrate volatilization and delivery in accordance with the present invention.

The female base 500 is used to detachably engage to the stem, fitting, or grounded joint of a downstream water vessel. The base cap 500 comprises an outer skirt 502 with an open bottom end. In the shown embodiments, the open end mates with a 12.5 mm male stem. The outer skirt 502 comprises a cylindrical enclosure with an open bottom end. The outer skirt 502 may vary from 2 millimeters in diameter to 50 millimeters in diameter.

The outer skirt 502 is sized to fit over the inlet tube, stem, fitting or grounded joint of the tool housing unit in the case of tool housing unit with a male joint. The diameter of the interior recess of the third female base 500 is not uniform, rather it is tiered (or birthday caked) to accommodate varying size male stems.

The outer skirt 502 is sized to be greater in diameter than the mid skirt 504, which is also sized to engagement and partially envelope a male joint on a tool housing unit, albeit one of lesser diameter than the outer skirt 502. The mid skirt 504 also comprises a cylindrical body with an open bottom end.

A top portion 506 of the female base 500 is also comprises a cylindrical body with both an open top end and an open bottom end. The exterior of the top portion 506 may be threaded for threadably engaging a female end of an adjoining component. The top end of the top portion 506 may be notched as shown. The diameter of the top portion is less than the diameter of the mid skirt. The diameter of the top portion is between 2 millimeters and 50 millimeters.

The third female base 500 may be formed as a single integrated piece and defines a through bore hole traversing the third female base cap 500 longitudinally.

One or more notches for allowing vapor or ambient air to be drawn into the enclosure may be defined by sidewalls of the third female base 500. The notches may be cut in diagonal fashion across the outer surface of the sidewall of the third female base 500 or other any other component forming the assembly 100.

Figure 6:
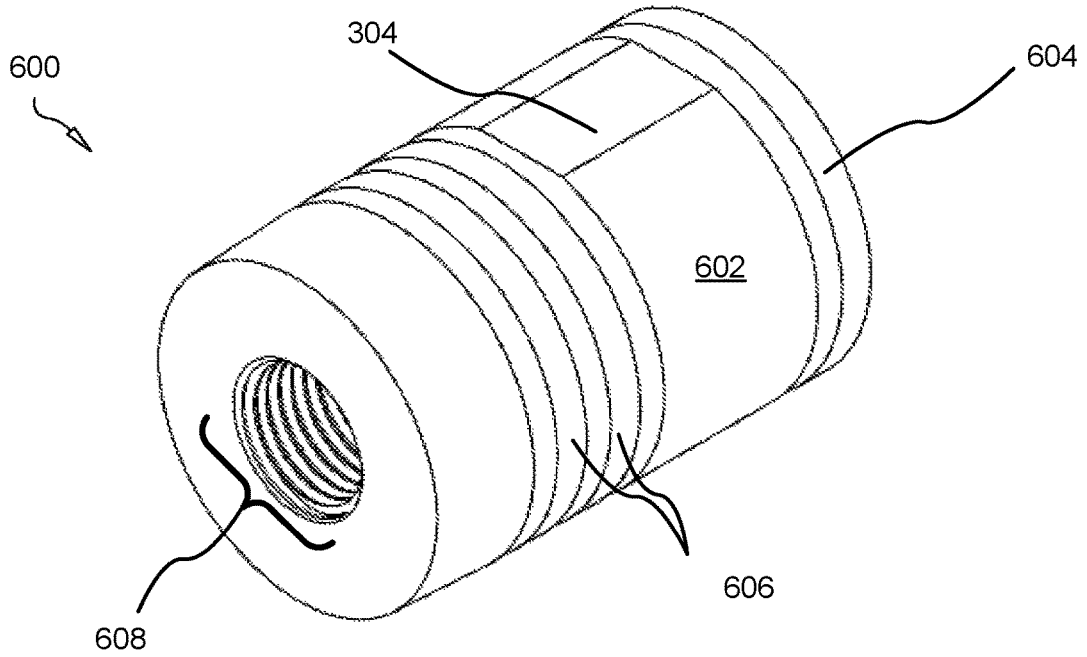
FIG. 6 is a lower side perspective view of a female base of an adjustable nail assembly for concentrate vaporization and delivery in its stock configuration in accordance with the present invention.

FIG. 6 is a lower side perspective view of a female base 600 of an adjustable nail assembly for concentrate volatilization and delivery in its stock configuration in accordance with the present invention.

The female base 600 comprises a cylindrical body 602 with knurled surfacing 304. The exterior surface of the cylindrical body 602 comprises a plurality of annular fins 606 circumscribing the cylindrical body 602. These annular fins help prevent heat transfer from end of the female base cap to another and may be formed through deductive manufacturing on a lathe.

The top end of the female base cap 600 is planar and defines an interiorly-threaded aperture for threadably receiving the male end of an adjoining component such as threads 404 on the male dish 400.

Figure 7A:
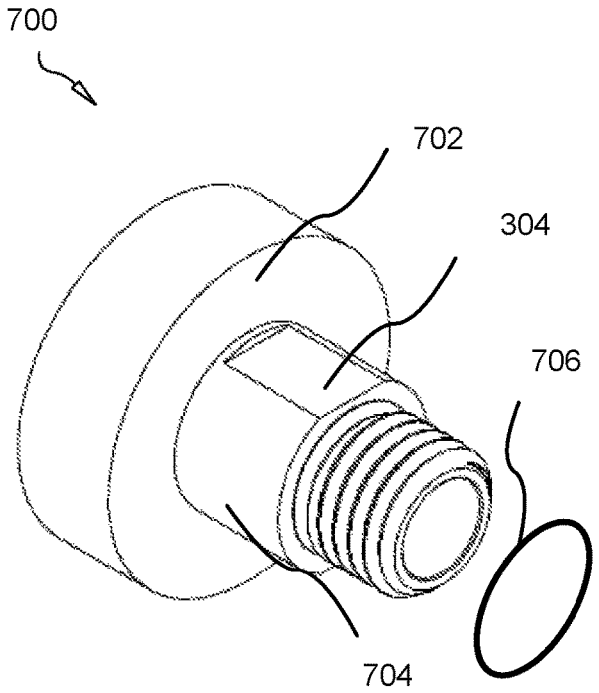
FIG. 7A is a lower side perspective view of a dish of an adjustable nail assembly for concentrate vaporization and delivery in its stock configuration in accordance with the present invention.
Figure 7B:
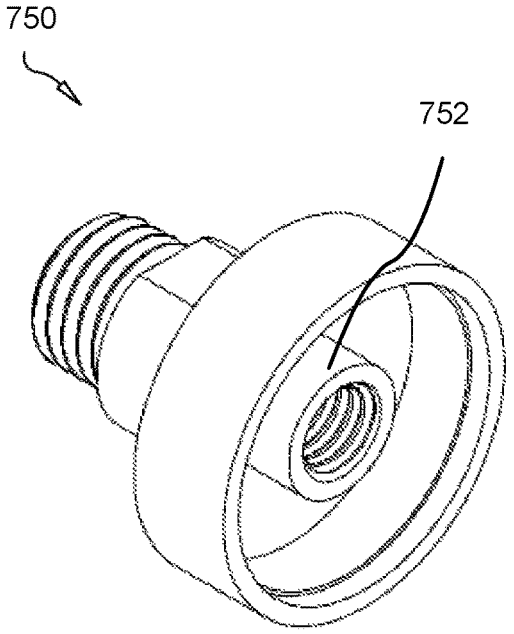
FIG. 7B is an upper side perspective view of a dish of an adjustable nail assembly for concentrate vaporization and delivery in its stock configuration in accordance with the present invention.

FIGS. 7A-7B constitute side perspective views of a dish 700, 750 of an adjustable nail assembly for concentrate vaporization and delivery in its stock configuration in accordance with the present invention.

The dish 700 comprises an upper portion 702 having a cylindrical body forming an enclosure with an open top end. Within the open top end is a planar interior floor from which a threaded collar 752 protrudes.

The threaded collar 752 defines a hollow bore hole for through passage of vapors, which bore hole is interiorly-threaded. The threaded color 752 prevents vestiges of concentrate placed into the open top end between the threaded collar 752 and the sidewall from becoming lodged in the bore hole or entering the downstream path toward the tool housing unit.

The dish 700 also comprises a lower portion 704 having a knurled surface 304, from which protrudes downwardly a threaded cylindrical male portion for threadably mating with a female aperture on an adjoining piece.

The dish 700 may further comprise an electronic heating coil for heating the dish 700 to a predetermined temperature to obviate the need for a torch by a user.

An electric heating coil is also provided for heating the dish 700 to predetermined temperature in some embodiments, and obviating the need for a torch by a user.

Figure 8A:
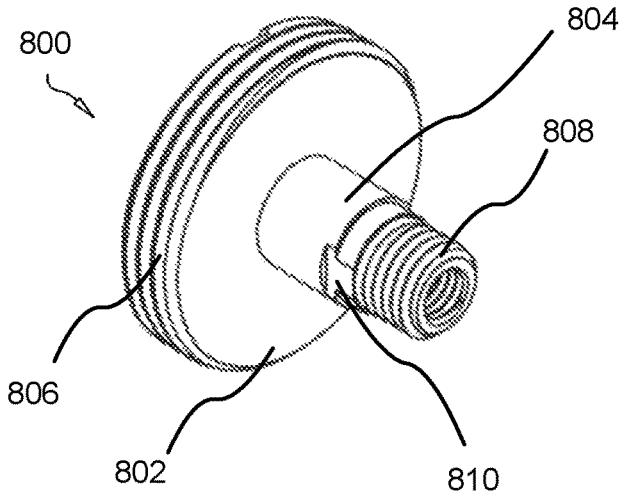
FIG. 8A is a lower side perspective view of a housing unit cap of an adjustable nail assembly for concentrate vaporization and delivery in its stock configuration in accordance with the present invention.

FIG. 8A is a lower side perspective view of a housing unit cap 800 of an adjustable nail assembly for concentrate volatilization and delivery in its stock configuration in accordance with the present invention.

The housing unit cap 800 is disposed over one end of the carb cap 1200 in the assembly 100. The housing unit cap 800 comprises a cylindrical top portion 802 with exteriorly surface having threads 806.

The housing unit cap 800 is affixed to a cylindrical lower portion 804 affixed to a centric protruding shortened cylindrical shaft having threads 808.

Figure 8B:
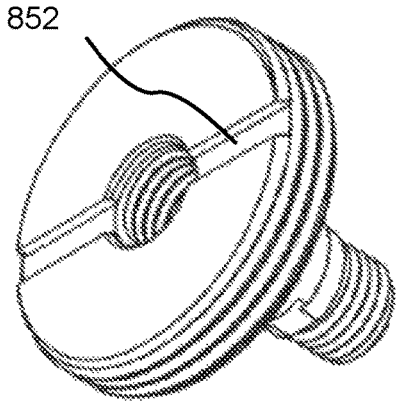
FIG. 8B is an upper side perspective view of a housing unit cap of an adjustable nail assembly for concentrate vaporization and delivery in its stock configuration in accordance with the present invention.

FIG. 8B is an upper side perspective view of a housing unit cap 800 of an adjustable nail assembly for concentrate volatilization and delivery in its stock configuration in accordance with the present invention.

As shown, the top surface may define a slot 852 spanning the entire diameter of the cap 800.

Figure 9:
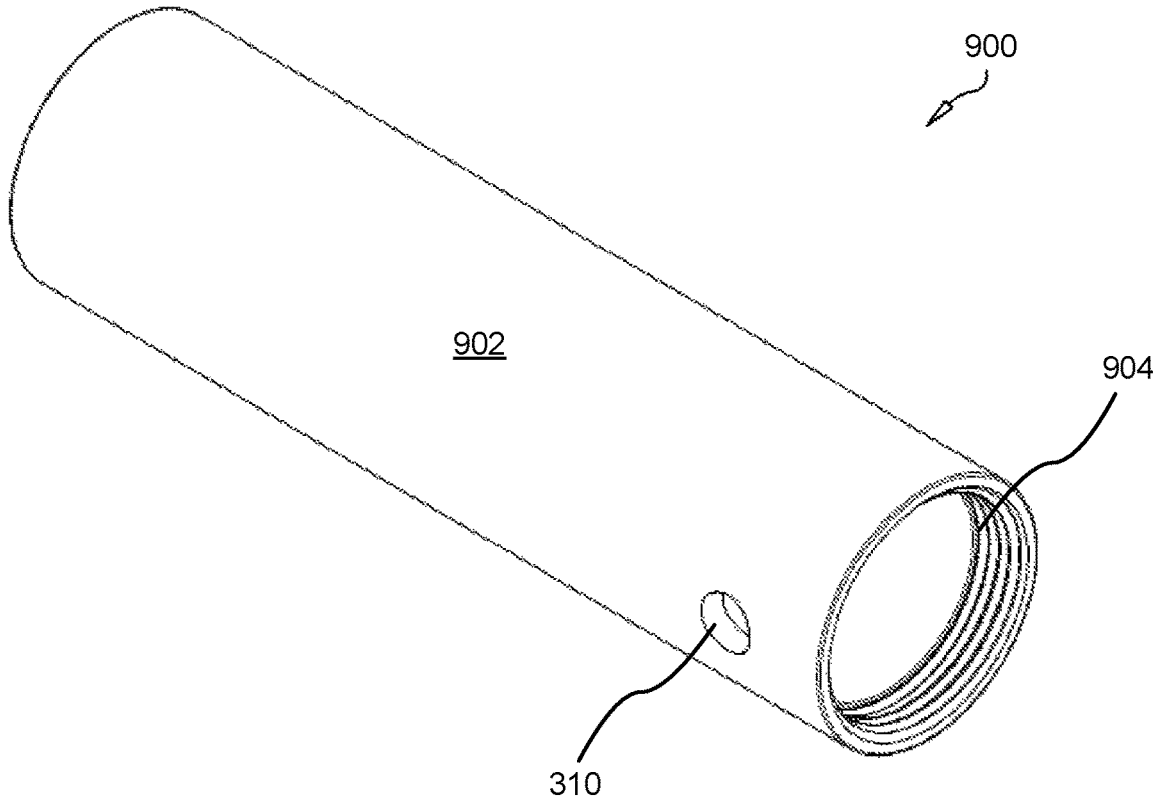
FIG. 9 is a lower side perspective view of a case (or tool housing unit) of an adjustable nail assembly for concentrate vaporization and delivery in its stock configuration in accordance with the present invention.

FIG. 9 is a lower side perspective view of a tool housing unit 900 of an adjustable nail assembly for concentrate vaporization and delivery in its stock configuration in accordance with the present invention.

The tool housing unit 900 comprises a cylindrical body 902 having a smooth exterior surface defining a side hole 310. The cylindrical body 902 defines an open top end and an open bottom end. The open bottom end comprises interior threading 904.

The tool housing unit 900 houses the remaining components of the assembly 100 for transport and storage.

In various embodiments, the tool housing unit 900 serves as the water vessel. The tool housing unit 900 encasing the components of the assembly 100 in its stock configuration, making transport and organization simpler. In other embodiments, the tool housing unit 900 detachably affixes to the other components to form a water vessel though which vapor are channeled.

Figure 10A:
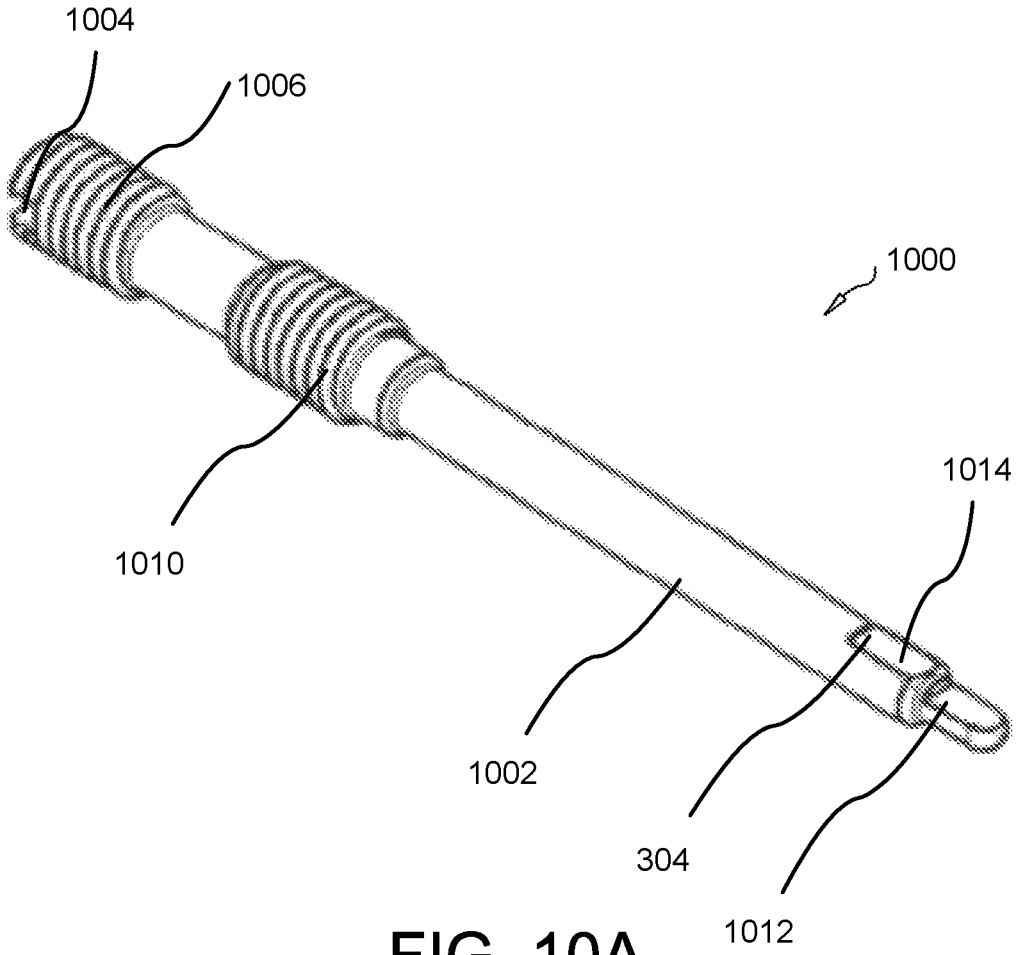
FIG. 10A is a lower side perspective view of a stylus of an adjustable nail assembly for concentrate vaporization and delivery in its stock configuration in accordance with the present invention.

FIG. 10A is a lower side perspective view of a stylus 1000 of an adjustable nail assembly for concentrate vaporization and delivery in its stock configuration in accordance with the present invention.

The stylus 1000 comprises an elongated rod 1008 having a distal end and a proximal end 1004. The proximal end 1004 may comprise threads 1006 for mating with adjoining components, including a carb cap 1200. The threads 1004 may threadably insert into a side hole 310 to form a hammer-type carb cap.

The rod 1002 may comprise threads 1010 at a midpoint on the rod 1002.

The distal end of the rod 1002 may be used for dabbing concentrate into a dish of the assembly 100 and comprises an applicator 1012. The applicator 1012 comprises a cylindrical portion cut to have two opposing planar exterior surfaces for engaging and scooping up concentrate.

The stylus 1000 inserts through the circular aperture for stacking the base cap 400, along with other components of the assembly 100, together in a stock configuration for transport and storage. An annular sidewall 452 circumscribes the open top end.

The open top end may be used for dabbing by a user. The user places concentrate using the stylus 1000 in the top end on the planar interior floor after the base cap 400 has been heated to, or in excess of, a predetermined temperature which may exceed 3,000 degrees Fahrenheit.

Figure 10B:
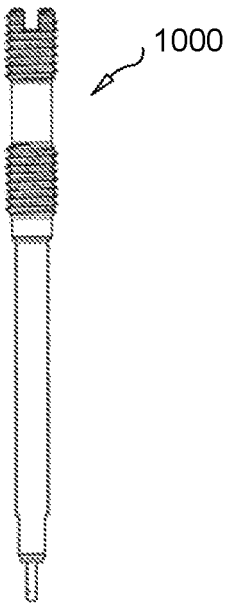
FIG. 10B is a side perspective view of a stylus of an adjustable nail assembly for concentrate vaporization and delivery in its stock configuration in accordance with the present invention.
Figure 10C:
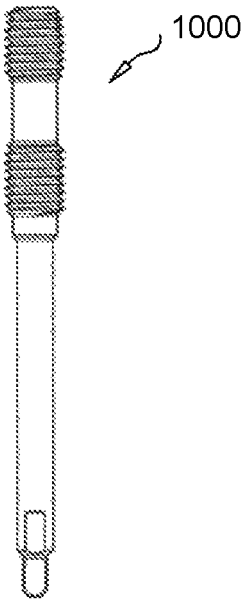
FIG. 10C is a side perspective view of a stylus of an adjustable nail assembly for concentrate vaporization and delivery in its stock configuration in accordance with the present invention.

FIG. 10B-10C as shown.

Figure 11:
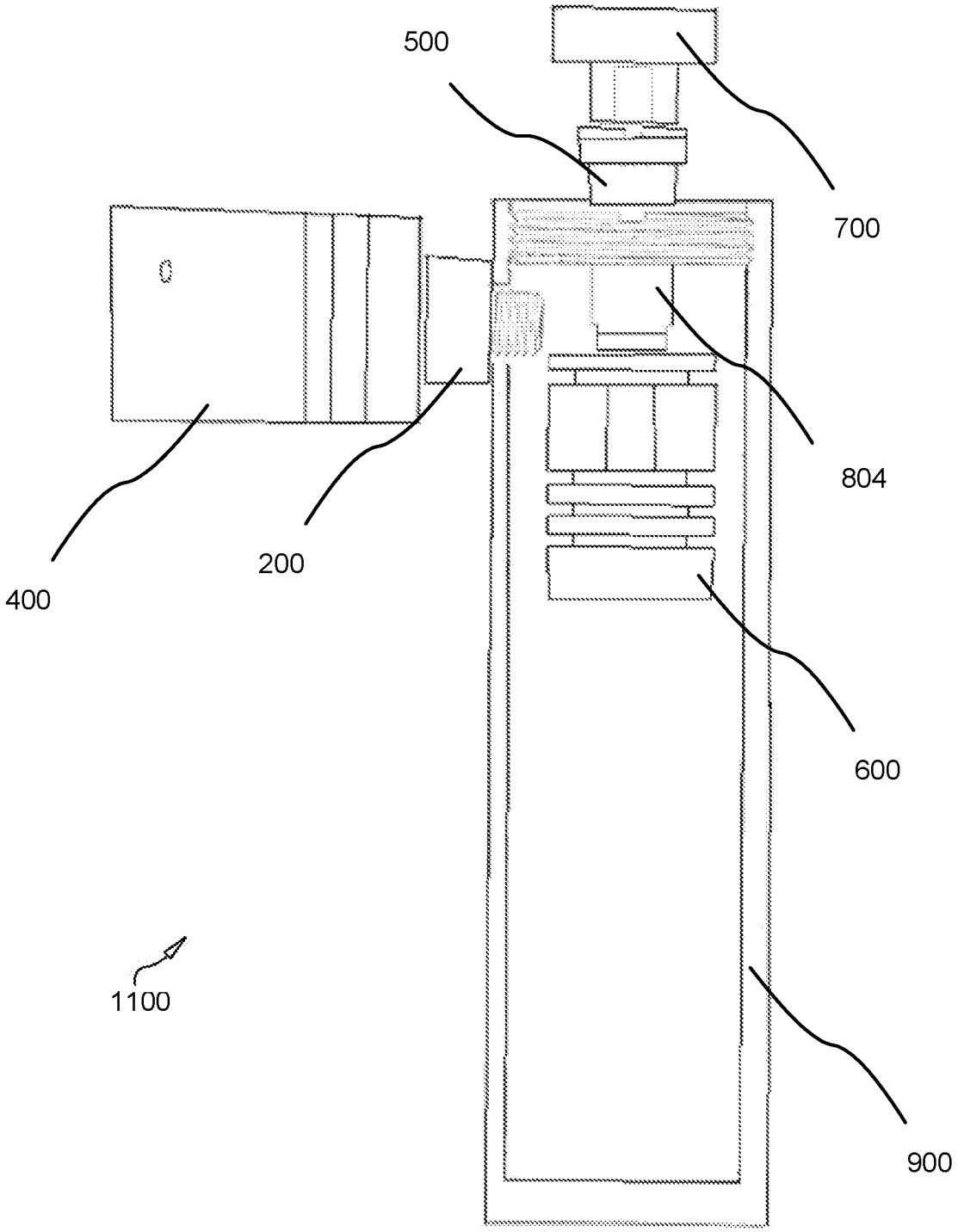
FIG. 11 is a side perspective view of a universal adjustable nail assembly for concentrate vaporization and delivery positioned for stock configuration in accordance with the present invention.

FIG. 11 is a side perspective view of a universal adjustable nail assembly 1100 for concentrate vaporization and delivery positioned for stock configuration in accordance with the present invention.

The assembly 1100 comprises a carb cap 400, a first female base 200, a case 900, a second female base 600, and a dish 700.

The shown embodiment illustrates an assembly 1100 of the components of assembly 100 configured to mate with a male stem on a tool housing unit. Oils, extracts or concentrate or place in the dish 700 which is heated to over 3,000 degrees using means known to those of skill in the art, including electric heating coils integrated into the dish 700 or a component abutting the dish 700 or a torch using combustible fuel.

Vapors enter the through passageway at the bottom of the dish 700 and emerge into the interior recess of the case 900 from the second female base 600. The first female base 200 in threadably mated with the case 900 via the sidehole 310 defined by the case 900. The carb cap 400 is threadably mated with the first female base 200.

As shown in FIG. 11, the case 900 can be used as the water vessel. In some embodiments, the entire assembly 100 forms a nail for use with an external water vessel, while in other embodiments, such as that shown, the components of the assembly 100 are configured to act as the water vessel itself. In these configurations, the case 900 acts as the body of the water vessel.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A universal adjustable nail assembly for volatilization and delivery of an extract, the nail assembly comprising:

a titanium dish comprising a cylindrical enclosure with an open top end, the open top end having a circumscribing annular sidewall and an interior planar floor defining a centric aperture allowing through passage of vapor, the open top end for receiving concentrate dabbed by a user, the open top end between 2 millimeters and 50 millimeters in diameter;

a first female base comprising an outer skirt of 2 millimeters to 50 millimeters in diameter, the outer skirt having an open bottom end for receiving a male grounded joint of a tool housing unit, the outer skirt affixed at a top end to a cylindrical mid skirt of smaller diameter than the diameter of the outer skirt for receiving the male grounded joint, the mid skirt affixed to a cylindrical top portion having exterior threads, the top portion defining an open top end;

two or more male base caps, each of the male base caps comprising a cylindrical body having two interconnected open ends, one of the open ends defining an aperture of sufficient diameter to enclose the titanium dish;

a second female base comprising a cylindrical body with a knurled exterior surface, the cylindrical body comprising a plurality of annular fins, the second female base comprising a planar top surface defining an aperture threaded to mate with a male portion of an adjoining component, the second female base comprising the open bottom end to be received by the first female grounded joint;

a stylus comprising an elongated shaft having a distal end and a proximal end, the distal end of the shaft comprising an applicator, the proximal end of the shaft threaded exteriorly;

a tool housing unit comprising a hollow cylindrical body for receiving the first female base, the stylus, the two or more base caps, the second female base, and the dish, wherein the tool housing unit defines two open ends, wherein a bottom open end is threaded interiorly; and a housing unit cap comprising a circular body having exterior threads for mating with interior threading on the open bottom end of the tool housing unit, the housing unit cap having a lower portion with exterior threads.

2. The nail assembly of claim 1, wherein the stylus further comprises threads at the midpoint on the elongated shaft.

3. The nail assembly of claim 1, wherein the top portion of the first female base comprises a notched outer rim.

4. The nail assembly of claim 1, wherein the housing unit cap defines a slot spanning a diameter of the circular body.

5. The nail assembly of claim 1, wherein each of the first female base, the stylus, the base cap, the second female base, and the male dish are formed as a single integrated piece.

6. The nail assembly of claim 1, wherein each of the first female base, the stylus, the metal base cap, the second female base, and the male dish may be inverted and threadably interconnected in a configuration adapted to join with the tool housing unit.

7. A universal adjustable nail assembly, the nail assembly comprising:

a titanium dish comprising a cylindrical enclosure with an open top end, the open top end having a circumscribing annular sidewall and an interior planar floor defining a centric aperture allowing through passage of vapor, the open top end for receiving concentrate dabbed by a user, the open top end between 2 millimeters and 50 millimeters in diameter;

a first female base comprising an outer skirt of 2 millimeters to 50 millimeters in diameter, the outer skirt having an open bottom end for receiving a male grounded joint of a tool housing unit, the outer skirt affixed at a top end to a cylindrical mid skirt of smaller diameter than the diameter of the outer skirt for receiving the male grounded joint, the mid skirt affixed to a cylindrical top portion having exterior threads, the top portion defining an open top end;

two or more male base caps, each of the male base caps comprising a cylindrical body having two interconnected open ends, one of the open ends defining an aperture of sufficient diameter to enclose the titanium dish;

a second female base;

stylus comprising an elongated shaft having a distal end and a proximal end, the distal end of the shaft comprising an applicator, the proximal end of the shaft threaded exteriorly;

a tool housing unit comprising a hollow cylindrical body for receiving the first female base, the stylus, the two or more male base caps, the second female base, and the dish, wherein the tool housing unit defines two open ends, wherein an open bottom end is threaded interiorly; and a housing unit cap comprising a circular body having exterior threads for mating with interior threading on the open bottom end of the tool housing unit, the housing unit cap having a lower portion with exterior threads.

* * * * *